US009060233B2

(12) United States Patent
Shennib et al.

(10) Patent No.: US 9,060,233 B2
(45) **Date of Patent: *Jun. 16, 2015**

(54) RECHARGEABLE CANAL HEARING DEVICE AND SYSTEMS

(71) Applicant: iHEAR MEDICAL, INC., San Leandro, CA (US)

(72) Inventors: Adnan Shennib, Oakland, CA (US); Victor Valenzuela, Hayward, CA (US); Greg Anderson, Fremont, CA (US)

(73) Assignee: iHEAR MEDICAL, INC., San Leandro, CA (US)

( * ) Notice: Subject to any disclaimer, the term of this patent is extended or adjusted under 35 U.S.C. 154(b) by 305 days.

This patent is subject to a terminal disclaimer.

(21) Appl. No.: 13/787,659

(22) Filed: Mar. 6, 2013

(65) Prior Publication Data

US 2014/0254844 A1 Sep. 11, 2014

(51) Int. Cl.
*H04R 25/00* (2006.01)

(52) U.S. Cl.
CPC ..... *H04R 25/556* (2013.01); *H04R 25/65* (2013.01); *H04R 25/602* (2013.01); *H04R 25/60* (2013.01)

(58) Field of Classification Search
CPC ..... H04R 25/65; H04R 25/602; H04R 25/60
USPC ..... 381/322, 323, 324
See application file for complete search history.

(56) References Cited

U.S. PATENT DOCUMENTS 5,197,332 A 3/1993 Shennib
5,327,500 A 7/1994 Campbell
5,553,152 A 9/1996 Newton
5,645,074 A 7/1997 Shennib et al.
5,659,621 A 8/1997 Newton (Continued)

FOREIGN PATENT DOCUMENTS

KR 1020100042370 A 4/2010
WO 99/07182 A2 2/1999

(Continued)

OTHER PUBLICATIONS

Abrams, ,"A Patient-adjusted Fine-tuning Approach for Optimizing the Hearing Aid Response", The Hearing Review, Mar. 24, 2011, 1-8.

(Continued)

*Primary Examiner* — Davetta W Goins
*Assistant Examiner* — Amir Etesam
(74) *Attorney, Agent, or Firm* — Dorsey & Whitney LLP

(57) ABSTRACT

Examples of a rechargeable canal hearing device and charging systems are described. An exemplary rechargeable hearing device includes a battery module and a main module adapted to be removably couple together to form a modular canal hearing device assembly configured to be inserted inconspicuously in the ear canal. The modular canal hearing device assembly may include electrical contacts or an inductive charging system to couple charging energy from a charging station. According to examples described, the charging station includes a receptacle cavity shaped to partially accommodate the modular canal hearing device assembly including its handle. The receptacle cavity includes features operable to manipulate the handle as an actuator for automatically disengaging the battery module from the main module upon insertion of the lateral end into the receptacle cavity.

40 Claims, 8 Drawing Sheets

(56) References Cited

U.S. PATENT DOCUMENTS

| | | | | |
|---|---|---|---|---|
| 5,701,348 | A | 12/1997 | Shennib et al. | |
| 5,785,661 | A | 7/1998 | Shennib et al. | |
| 6,137,889 | A | 10/2000 | Shennib et al. | |
| 6,212,283 | B1 | 4/2001 | Fletcher et al. | |
| 6,359,993 | B2 | 3/2002 | Brimhall | |
| 6,367,578 | B1 | 4/2002 | Shoemaker | |
| 6,428,485 | B1 | 8/2002 | Rho | |
| 6,473,513 | B1 | 10/2002 | Shennib et al. | |
| 6,546,108 | B1 * | 4/2003 | Shennib et al. | 381/322 |
| 6,674,862 | B1 | 1/2004 | Magilen | |
| 6,724,902 | B1 | 4/2004 | Shennib et al. | |
| 6,840,908 | B2 | 1/2005 | Edwards et al. | |
| 6,937,735 | B2 | 8/2005 | DeRoo et al. | |
| 6,940,988 | B1 | 9/2005 | Shennib et al. | |
| 6,978,155 | B2 | 12/2005 | Berg | |
| 7,010,137 | B1 | 3/2006 | Leedom et al. | |
| 7,016,511 | B1 | 3/2006 | Shennib | |
| 7,113,611 | B2 | 9/2006 | Leedom et al. | |
| 7,215,789 | B2 | 5/2007 | Shennib et al. | |
| 7,260,232 | B2 | 8/2007 | Shennib | |
| 7,298,857 | B2 | 11/2007 | Shennib et al. | |
| 7,310,426 | B2 | 12/2007 | Shennib et al. | |
| 7,321,663 | B2 | 1/2008 | Olsen | |
| 7,403,629 | B1 | 7/2008 | Aceti et al. | |
| 7,424,123 | B2 | 9/2008 | Shennib et al. | |
| 7,424,124 | B2 | 9/2008 | Shennib et al. | |
| 7,580,537 | B2 | 8/2009 | Urso et al. | |
| 7,664,282 | B2 | 2/2010 | Urso et al. | |
| 7,945,065 | B2 | 5/2011 | Menzl et al. | |
| 8,073,170 | B2 | 12/2011 | Kondo et al. | |
| 8,077,890 | B2 | 12/2011 | Schumaier | |
| 8,155,361 | B2 | 4/2012 | Schindler | |
| 8,184,842 | B2 | 5/2012 | Howard et al. | |
| 8,284,968 | B2 | 10/2012 | Schumaier | |
| 8,396,237 | B2 | 3/2013 | Schumaier | |
| 8,467,556 | B2 | 6/2013 | Shennib et al. | |
| 2001/0008560 | A1 | 7/2001 | Stonikas et al. | |
| 2002/0027996 | A1 | 3/2002 | Leedom et al. | |
| 2002/0085728 | A1 | 7/2002 | Shennib et al. | |
| 2003/0007647 | A1 | 1/2003 | Nielsen et al. | |
| 2005/0245991 | A1 | 11/2005 | Faltys et al. | |
| 2005/0259840 | A1 | 11/2005 | Gable et al. | |
| 2005/0283263 | A1 | 12/2005 | Eaton et al. | |
| 2006/0291683 | A1 | 12/2006 | Urso et al. | |
| 2007/0076909 | A1 | 4/2007 | Roeck et al. | |
| 2008/0240452 | A1 | 10/2008 | Burrows et al. | |
| 2008/0273726 | A1 | 11/2008 | Yoo et al. | |
| 2010/0040250 | A1 | 2/2010 | Gerbert | |
| 2010/0119094 | A1 | 5/2010 | Sjursen et al. | |
| 2010/0239112 | A1 | 9/2010 | Howard et al. | |
| 2010/0284556 | A1 | 11/2010 | Young | |
| 2011/0058697 | A1 * | 3/2011 | Shennib et al. | 381/314 |
| 2011/0200216 | A1 | 8/2011 | Lee et al. | |
| 2012/0051569 | A1 | 3/2012 | Blamey et al. | |
| 2012/0302859 | A1 | 11/2012 | Keefe | |
| 2013/0243229 | A1 | 9/2013 | Shennib et al. | |
| 2014/0254843 | A1 | 9/2014 | Shennib | |
| 2015/0023512 | A1 | 1/2015 | Shennib | |
| 2015/0023534 | A1 | 1/2015 | Shennib | |

FOREIGN PATENT DOCUMENTS

| | | | |
|---|---|---|---|
| WO | 2010/091480 | A1 | 8/2010 |
| WO | 2011128462 | A2 | 10/2011 |
| WO | 2015009564 | A1 | 1/2015 |
| WO | 2015009569 | A1 | 1/2015 |

OTHER PUBLICATIONS

Asha, , "Type, Degree, and Configuration of Hearing Loss", American Speech-Language-Hearing Association; Audiology Information Series, May 2011, 1-2.

Convery, et al., "A Self-Fitting Hearing Aid: Need and Concept", http://tia.sagepubl.com, Dec. 4, 2011, 1-10.

Franks, , "Hearing Measurements", National Institute for Occupational Safety and Health, Jun. 2006, 183-232.

Nhanes, , "Audiometry Procedures Manual", National Health and Nutrition Examination Survey. Jan. 2003, 1-105.

Traynor, , "Prescriptive Procedures", www.rehab.research.va.gov/mono/ear/traynor.htm, Jan. 1999, 1-16.

World Health Organization, , "Deafness and Hearing Loss", www.who.int/mediacentre/factsheets/fs300/en/index.html, Feb. 2013, 1-5.

International Search Report and Written Opinion dated Nov. 3, 2010 for PCT Appl. No. US2010/048299.

"Lyric User Guide," http://www.phonak.com/content/dam/phonak/b2b/C_M_tools/Hearing_Instruments/Lyric/documents/02-gb/Userguide_Lyric_V8_GB_FINAL_WEB.pdf, Jul. 2010, pp. 1-36, Phonak AG.

"Operations Manual—2011," AMP Personal Audio Amplifiers, 2011, pp. 1-20.

International Search Report and Written Opinion for PCT/US2014/046350, mailed Nov. 6, 2014.

International Search Report and Written Opinion for PCT/US2014/046335.

* cited by examiner

RECHARGEABLE CANAL HEARING DEVICE AND SYSTEMS

TECHNICAL FIELD

Examples described herein relate to hearing devices, and include particularly hearing devices that are positioned in the ear canal for inconspicuous wear. This application is related to pending patent application Ser. No. 12/878,926, titled CANAL HEARING DEVICE WITH DISPOSABLE BATTERY MODULE, filed Sep. 9, 2010, Ser. No. 13/424,242, titled BATTERY MODULE FOR PERPENDICULAR DOCKING INTO A CANAL HEARING DEVICE, filed Mar. 19, 2012, and concurrently filed patent application Ser. No. 13/787,653, titled DISENGAGEMENT TOOL FOR A MODULAR CANAL HEARING DEVICE AND SYSTEMS INCLUDING SAME, filed Mar. 6, 2013, all three of which applications are incorporated herein by reference in their entirety for any purpose.

BACKGROUND

The ear canal 10, as illustrated in FIG. 1, is generally narrow and tortuous and is approximately 26 millimeters (mm) long from the canal aperture 11 to the tympanic membrane 15 (eardrum). The lateral part 12 is referred to as the cartilaginous region due to the underlying cartilaginous tissue 16 beneath the skin. The medial part, proximal to the tympanic membrane 15, is rigid and referred to as the bony region 13 due to the underlying bone tissue 17. A characteristic first bend occurs roughly at the aperture 11 of the ear canal. A second characteristic bend occurs roughly at the bony-cartilaginous junction 8 and separates the cartilaginous region 12 and the bony region 13. The ear canal 10 is generally hidden from view (front and side) behind a backward projecting eminence known as the tragus 3. The ear canal is also hidden from view from the back by the presence of the pinna 4 (also referred to as auricle). The dimensions and contours of the ear canal 10 vary significantly among individuals.

Placement of a hearing device inside the ear canal 10 is generally desirable for various electroacoustic advantages such as reduction of the acoustic occlusion effect, improved energy efficiency, reduced distortion, reduced receiver vibrations, and improved high frequency response. Canal placement may also be desirable for cosmetic reasons since the majority of the hearing impaired may prefer to wear an inconspicuous hearing device. A canal hearing device can be inserted entirely or partially inside the ear canal. In the context of this application, any hearing device inserted inside the ear canal, whether partially or completely, may be referred to as a canal hearing device. This includes what is known in the hearing aid industry as Completely In the Canal (CIC), In-The-Canal (ITC), and extended wear deep canal invisible types.

Conventional batteries for canal hearing devices include zinc-air varieties, which are generally non-rechargeable, thus replaced frequently by the user. Given the advanced age of the average hearing aid user and diminutive size of canal hearing device batteries, it is an inconvenient and often a frustrating task to replace the batteries due to decreased dexterity and impaired vision. Furthermore, standard zinc-air batteries can drain prematurely due to continuous internal discharge after removing the air-access tab as known in the hearing aid field. Rechargeable hearing aids on the market are generally limited to the relatively unsightly larger devices in the form of Behind-The-Ear (BTE), In-The-Ear, and Receiver-In-The-Canal (RIC), which are typically made sufficiently large to accommodate charging mechanisms, without the need to remove the battery cell within during charging.

SUMMARY

The present disclosure describes examples of rechargeable canal hearing aid devices and systems including a modular canal hearing device (interchangeably referred to herein as a canal hearing device assembly) and charging station adapted to supply electrical energy to the modular canal hearing device. In preferred embodiments, the canal hearing device assembly is charged by placing the lateral end of the canal hearing device assembly into a receptacle cavity incorporated within a charging station as will be further described.

In one embodiment of the present invention, the rechargeable hearing aid system includes a modular hearing device with a main module, a battery module, and a charging station. The main module and the battery module are configured to join to form a canal hearing device assembly. The main module includes a microphone, a receiver and circuitry. The battery module, incorporating a rechargeable battery cell therein, is configured for mating with the lateral end of the main module forming the lateral end of the canal hearing device assembly, which may include a handle. In a preferred embodiment, the charging station includes a channel for receiving the handle and configured to actuate the handle to disengage, at least partially, the battery module and electrically disengage the battery cell within.

In one embodiment of the present invention, the battery module incorporates a sound port for receiving sound and delivering it to a microphone within the main module.

In one embodiment, the charging station is configured to partially disengage the battery module to automatically switch off the canal hearing device assembly upon insertion of the lateral end of the canal hearing device assembly into the receptacle cavity.

In the preferred embodiments, the charging station includes circuitry for controlling and monitoring the charging condition of the battery cell. The charging station may include a USB connector for supplying power from an external source. The charging station may be configured to provide electrical charge to the battery cell via direct electrical contacts, or indirectly via inductive coupling.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION

Figure 1:
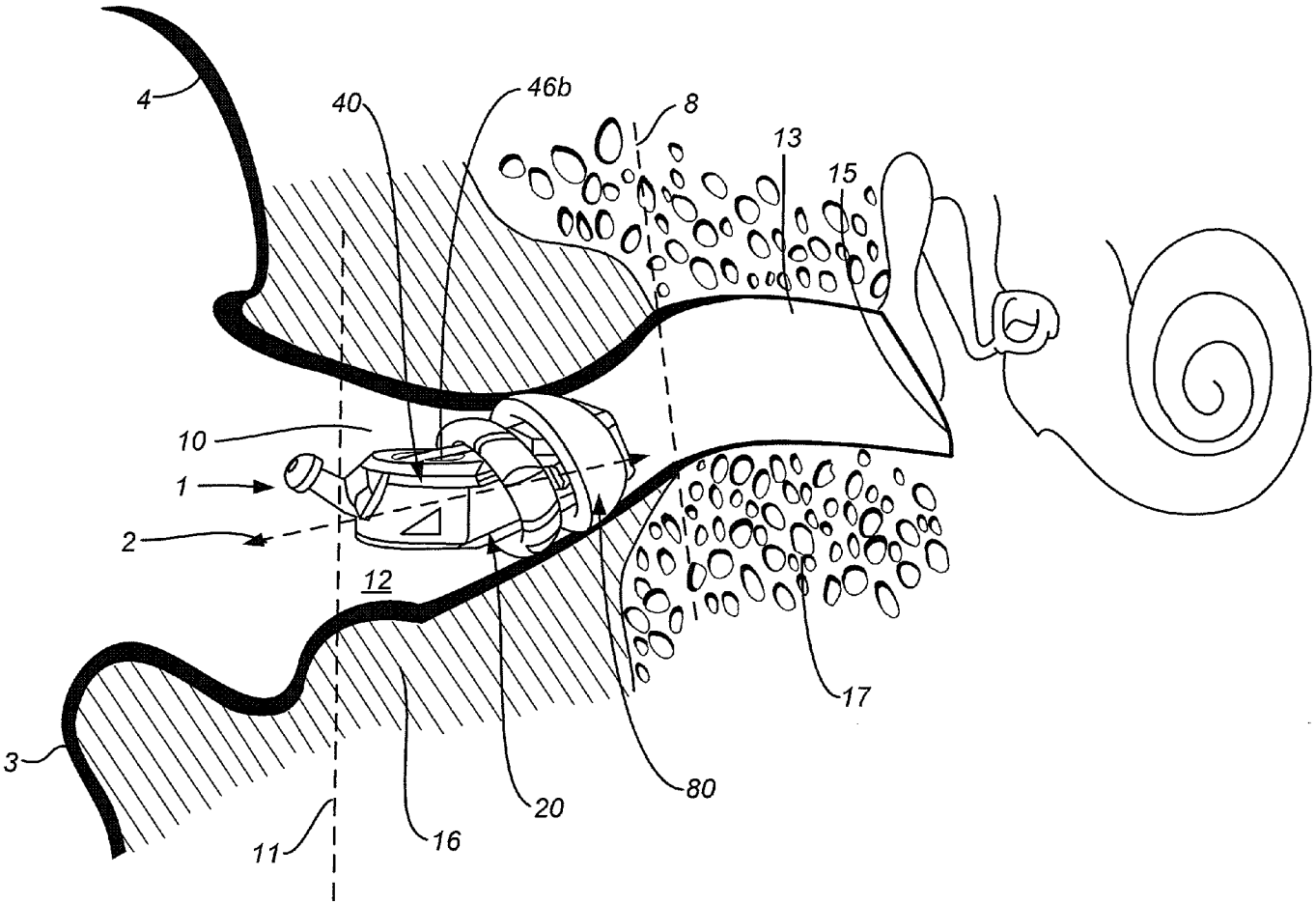
FIG. 1 is a view of the ear canal, showing an example of a modular rechargeable canal hearing device assembly inserted therein.

Certain details are set forth below to provide a sufficient understanding of embodiments of the invention. However, it will be appreciated by one skilled in the art that some embodiments may not include all details described. In some instances, well-known structures, hearing aid components, circuits, and controls, have not been shown in order to avoid unnecessarily obscuring the described embodiments of the invention.

The present disclosure describes, with reference to FIGS. 1-10, examples of rechargeable canal hearing aid devices and systems including the same. A canal hearing device system according to one example of the present disclosure includes a main module 20, a battery module 40, and a charging station 60. The main module 20 is configured for positioning substantially in the ear canal 10 and includes a microphone, a receiver and circuitry operatively coupling the microphone to the receiver. The battery module 40, incorporating a battery cell 42 therein, is configured for mating with the lateral end 32 (away from the eardrum) of the main module 20, which is also the lateral end of the canal hearing device assembly 1. For example, the battery module 40 may be configured for a cooperating fit within a portion of the main module 20, as will be further described. The battery module 40 and main module 20 when coupled together form a canal hearing device assembly 1. The charging station 60, as will be further described with reference to FIGS. 5-10, is configured for providing electrical charge to the battery cell 42, and includes a receptacle cavity 70 for receiving the lateral end of the canal hearing device assembly 1, generally along a longitudinal axis 2 of the canal hearing device assembly 1.

The charging station 60 may be configured to provide electrical charge to the battery cell 42, as will be further described below with reference to the figures. The charging station 60 may include one or more electrical contacts 76*a* and 76*b* for establishing a direct electrical connection with the electrical contacts 46*a* and 46*b* on the exterior of the lateral end of the canal hearing device assembly 1. In other examples, the charging station 60 may be configured to provide electrical charge wirelessly to the battery cell 42 by inductive coupling. That is, the charging station 60 may include a coil 64 configured to be inductively couple the battery and circuitry within the charging station 60 for wirelessly delivering charge to the battery cell 42. In further examples a coil 49 may instead be provided in the canal hearing device assembly 1. For example, the lateral end of the canal hearing device assembly 1 may include a coil 64 for inductively-coupling electrical energy between the charging station 60 and the battery cell 42. The charging station 60 may include a connector 61, such as a USB connector or any other standardized connector, for coupling the charging station 60 to an external power and/or data source. In other examples, the charging station 60 may include a single-use or a rechargeable battery instead of or in addition to being configured to be coupled to an external power source.

The charging station 60 may include a receptacle cavity 70 which is configured to receive the lateral end of the canal hearing device assembly. The receptacle cavity 70 may include first features which are configured to constrain a movement of the main module 20 with respect to the charging station 60 when the canal hearing device assembly 1 is inserted therein. The receptacle cavity 70 may include additional features, for example a disengaging structure 71 configured to actuate the battery module 40 relative to the main module 20 upon insertion of the lateral end into the charging station for partially disengaging the battery module from the main module. In some embodiments, the receptacle cavity may include a channel 77 which is configured to accommodate the handle 50. The channel 77 may be so shaped as to push the handle 50 upwards relative to the main module 20 upon insertion of the canal hearing device assembly 1 into the charging station 60. In some examples, a first portion of the receptacle cavity 70 may be wider and/or taller than at least a portion of the channel 77. The channel 77 may be defined by a step or a ledge which narrows the cavity and which facilitates engagement with (e.g. an actuation of) the handle as described herein.

Figure 2:
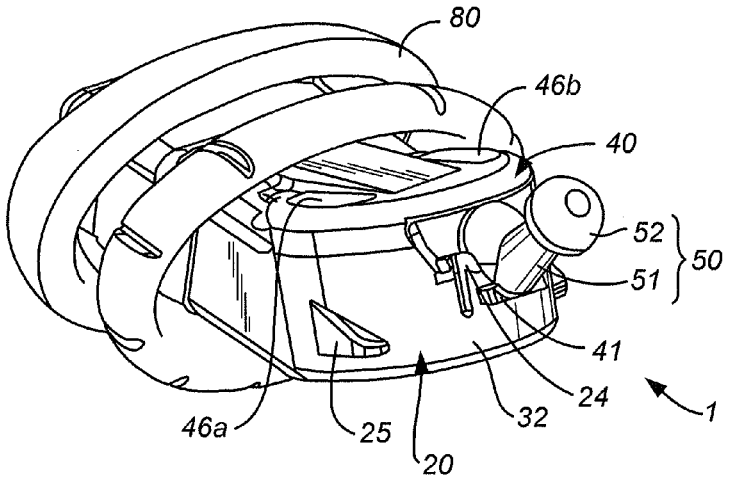
FIG. 2 is an isometric view of a modular canal hearing device assembly depicting the main module engaged with the battery module and a seal assembly attached.
Figure 3:
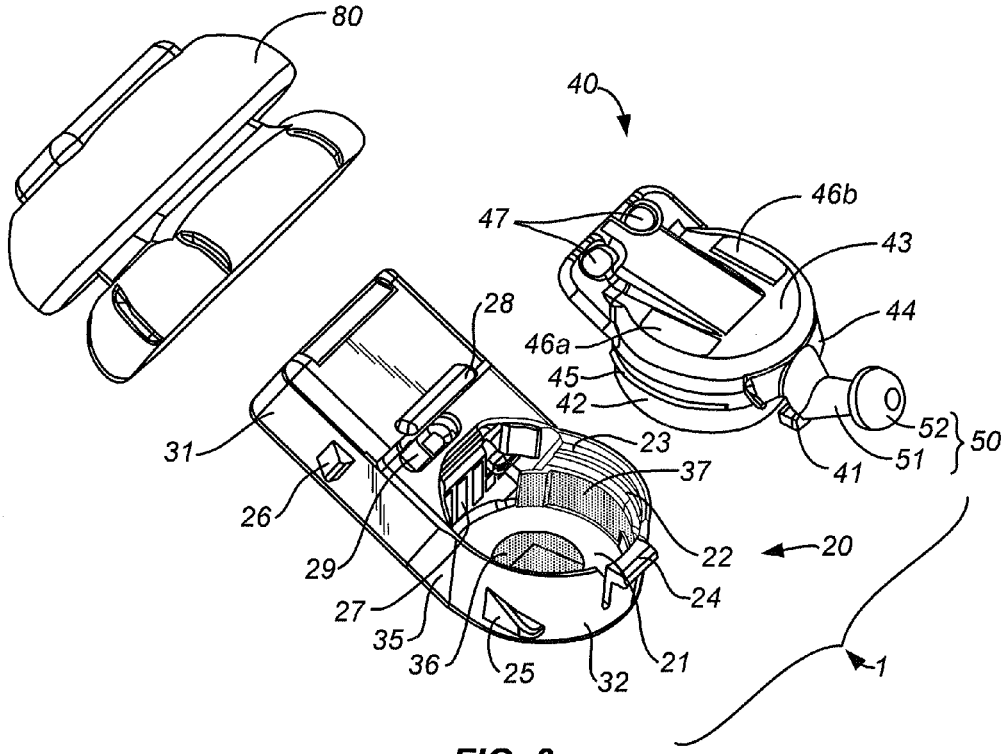
FIG. 3 is an exploded view of the modular canal hearing device assembly of FIG. 2, depicting the battery module and seal assembly fully disengaged from the main module.
Figure 4:
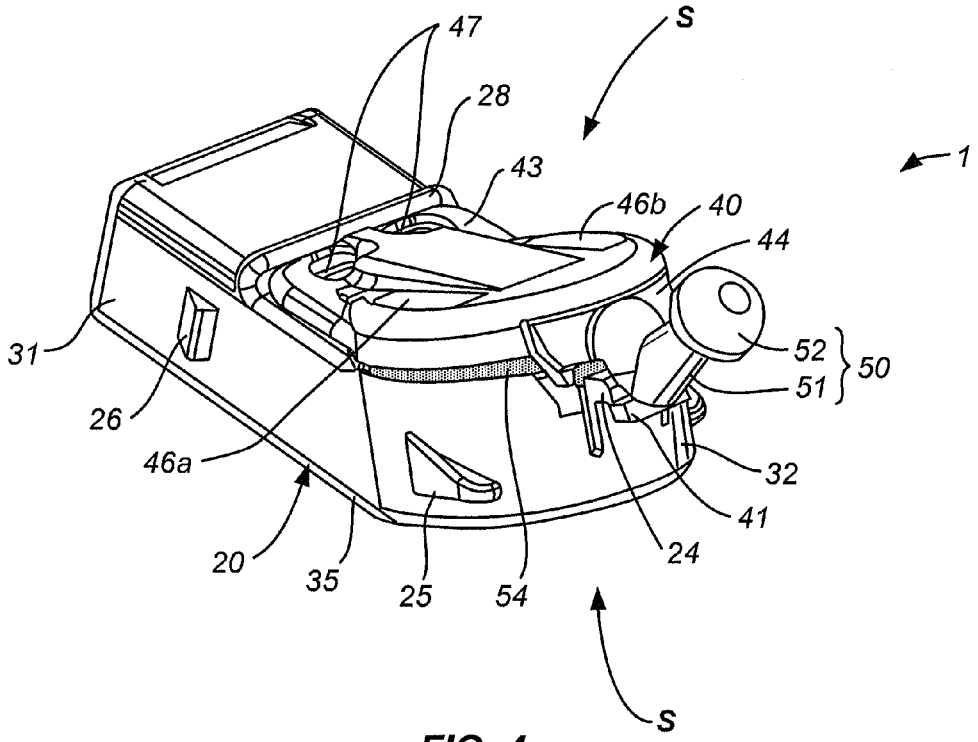
FIG. 4 is an isometric view of the modular canal hearing device assembly of FIG. 2, depicting the battery module partially disengaged from the main module, with a gap therebetween representing the OFF condition.
Figure 5:
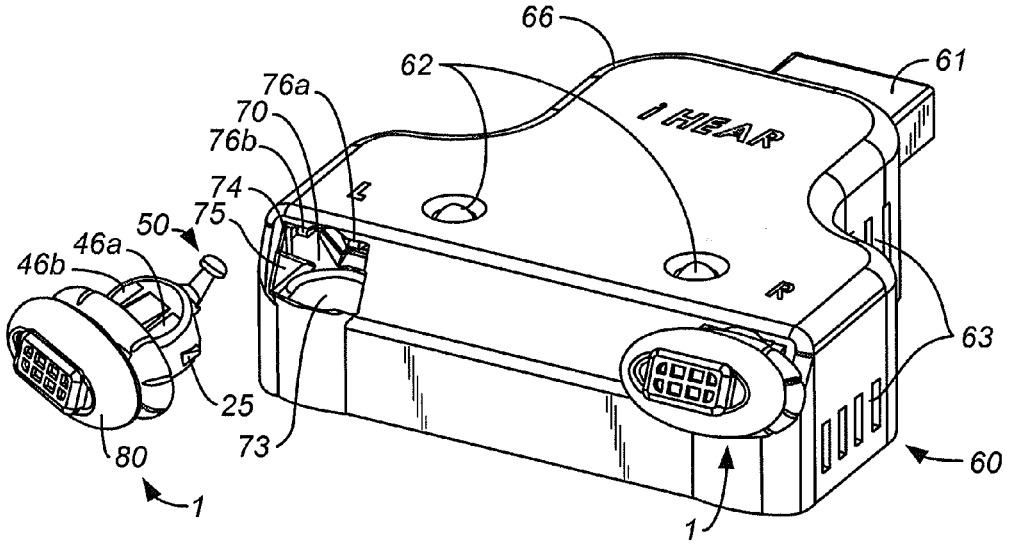
FIG. 5 is an isometric view of an example of a rechargeable hearing device system showing a first modular canal hearing device assembly prior to insertion into a first (left) receptacle cavity of a charging station, and a second modular canal hearing device assembly inserted into a second (right) receptacle cavity.
Figure 6:
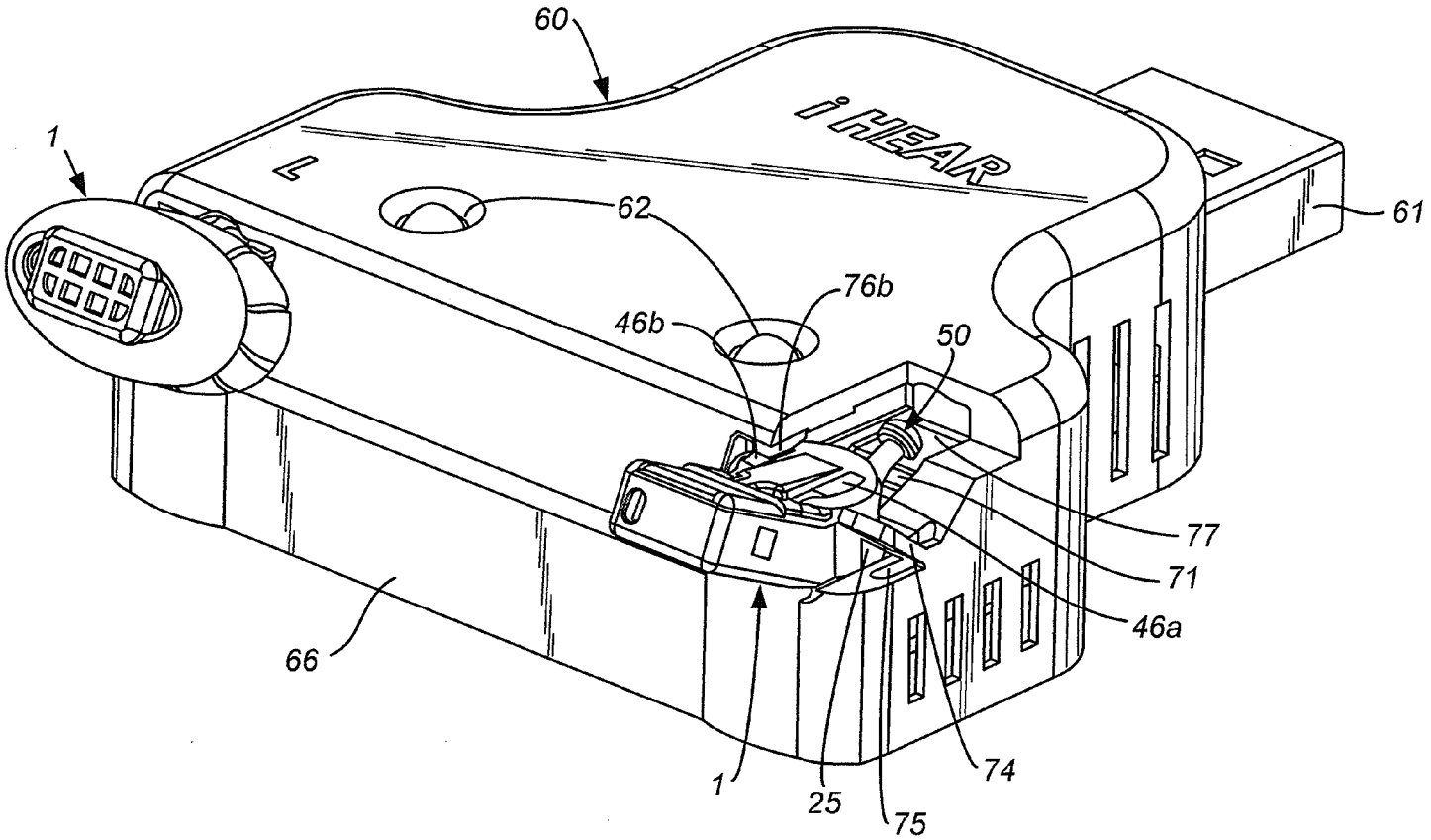
FIG. 6 is an isometric view of the charging station of FIG. 5, depicting a cut-away view of the right cavity of the charging station with a modular canal hearing device assembly inserted therein.
Figure 7:
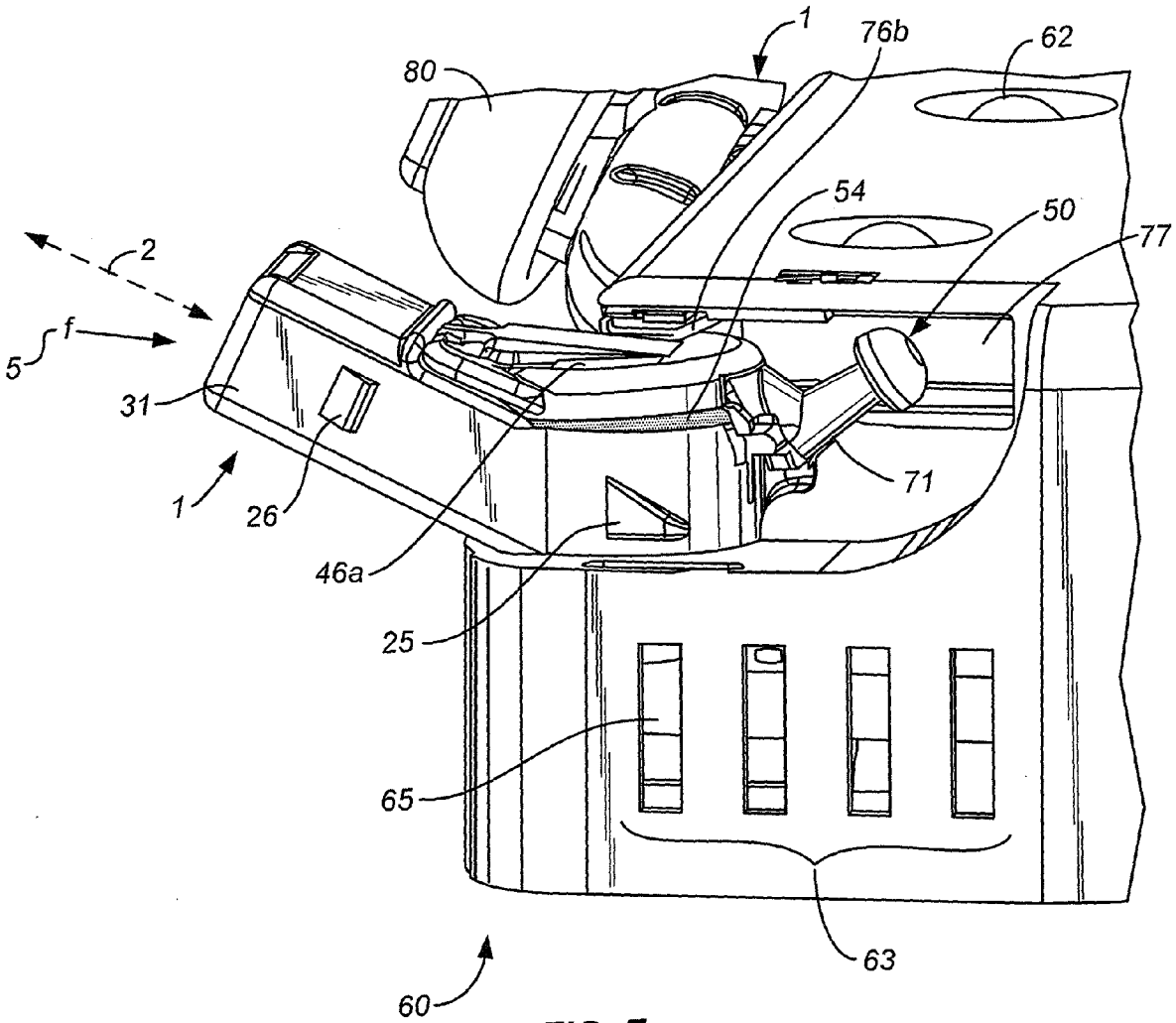
FIG. 7 is a more detailed cut-away view of the right cavity of the charging station in FIGS. 5 and 6 showing the disengaging features within the receptacle cavity and the battery module partially disengaged.
Figure 8:
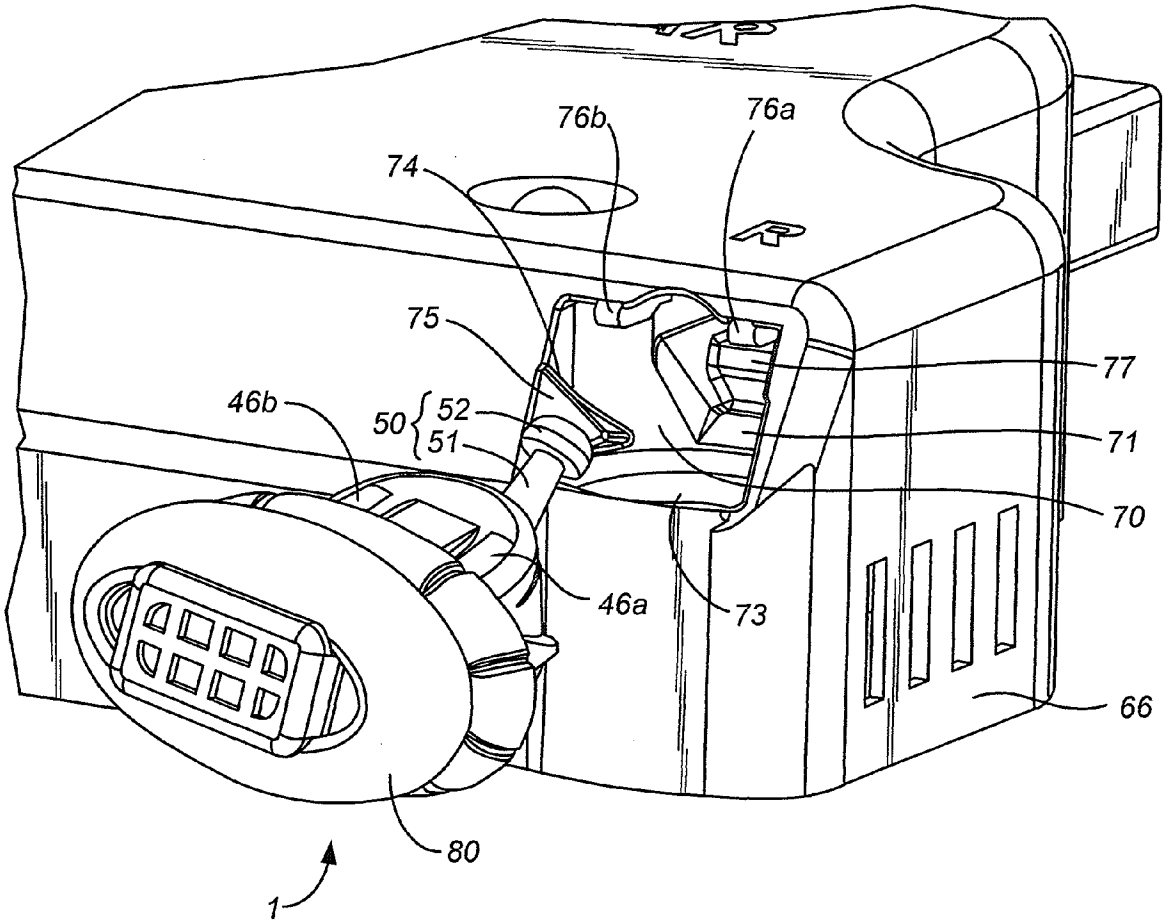
FIG. 8 is an alternate view of the charging station of FIG. 5 showing holding and disengaging features within the receptacle cavity and a canal hearing device assembly prior to insertion into the receptacle cavity.

As noted above, the canal hearing device assembly 1 (also referred to herein as canal hearing device or canal hearing aid), includes a main module 20 and a battery module 40, for example as shown in FIGS. 2-4. The main module 20 may be generally rectangular in cross section and having a medial end 31 (towards the eardrum) and a lateral end 32 (away from the eardrum). Other form factors for the cross section may of course be used. For example, the main module 20 may be generally cylindrical in shape. The main module 20 includes a microphone (not shown), a receiver (not shown) and circuitry (not shown), which may be enclosed at least in part within a housing 35 of the main module 20, examples of which are described in related U.S. patent application Ser. No. 12/878,926 & 13/424,242. In some examples, the circuitry of the main module 20 includes a digital signal processor (not shown). The main module 20 may include a receiving cavity 21, for example as shown in FIG. 3, shaped to accommodate the battery module 40 therein, and particularly the battery cell 42 within enclosed, at least partially, within the battery module 40. The battery cell 42 may have a generally circular shape, and may for example be a button cell. The main module 20 may include electrical contacts 36 and 37 for electrically coupling the main module 20 with the battery cell 42 to power the electrical components within the main module 20 (e.g., amplifier circuitry and microphone). In some examples, the main module 20 includes additional electrical contacts such as data contacts 27 for programming and communications with the main module by an external programming device (not shown). The main module 20 may include a sound aperture 29 (FIG. 3) which is configured to mate with a sound port 47 of the battery module 40 when the main module 20 and battery module 40 are in engagement. When the battery module 40 and main module 20 are coupled together, the sound aperture 29 and sound port 47 may be arranged relative to each other so as to define an acoustic path for incoming sound to reach the microphone.

The main module 20 includes a main module housing 35 which includes certain features configured for secure engagement of the main module 20 with the battery module 40, the charging station 60, and/or a seal tip assembly 80. These features may be implemented according to a variety of form factors as may be suitable for the particular application. For example, the lateral end 32 of the main module 20 may include a feature 24 (also referred to herein as a stop tab) configured to engage with a feature 41 (also referred to herein as a latch tab) positioned generally on the lateral end 44 of the battery module 40. In the particular example depicted in FIGS. 2-4, the stop tab 24 is implemented as a generally elongated element attached to or integrally formed with the handle 50, which stop tab is shaped and positioned on the handle 50 for a cooperating engagement with the latch tab 41, implemented here as a generally L-shaped member at the lateral end of the main module. Additionally, the main module 20 may include a feature 28 (also referred to herein as a battery module holding ledge) configured to securely hold the battery module 40 in a pivoting manner within the main module 20. In the particular example depicted in FIGS. 2-4, the battery module holding ledge 28 is positioned generally on the center portion of the main module 20. Other form factors may be used. The engagement between the stop tab 24 and the latch tab 41 provides safety engagement between the main module 20 and the battery module 40 when the modules are partially disengaged as will be described below.

In one example embodiment, the main module 20 includes two circumferential features (e.g., lower and upper holding grooves 22 and 23, respectively) incorporated within the receiving cavity 21, wherein the grooves 22, 23 are configured to lock the battery module 40 into one of two positions, representing a power ON position and a power OFF position. The circumferential features (e.g. grooves 22 and 23) are complimentary to a circumferential feature 45 (e.g. holding detent) of the battery module 40. As will be appreciated, in some examples, the circumferential grooves 22, 23 and corresponding detent 45 may be continuous (e.g. extend around the full perimeters of the main module 20 and/or battery module 40), or alternatively they may span only portions of the respective perimeters of the modules. The lower holding groove 22 secures the holding detent 45 of the battery module 40 such that the modular canal hearing device assembly 1 is in the power ON position, whereby the battery cell 42 is electrically engaged with electrical contact 36. On the other hand, the upper holding groove 23 secures the holding detent 45 of the battery module 40 such that the battery cell 42 is electrically disengaged from electrical contact 36, thus the canal hearing device assembly 1 is in the power OFF position. When the battery module 40 is provided in the OFF position, a gap 54 (see FIG. 4), which may be relatively narrow (e.g. a fraction of the height of the battery module 40) in some examples, may be formed separating the battery module 40 and the main module 20 at the lateral end of the hearing device assembly 1. As described above, the stop tab 24 may be arranged so at to define the amount of separation (e.g. gap 54) between the battery module 40 and the main module 20 and limit or prevent any further separation wider than the gap 54. The canal hearing device assembly 1 may be switched from the power ON position to the power OFF position by a manual action, or by the automatic displacement mechanism of the present invention as will be described herein.

In one embodiment, the lateral end 32 of the main module 20 includes features 25 for securing the lateral end 32 of the modular canal hearing device assembly 1 in the charging station 60 as further described herein. The features 25 (also referred to herein as holding tabs (only one holding tab being visible from one side) are configured to engage with complementary holding features 75 and 74, also referred to herein as holding recess 75 and holding ledge 74, of the charging station 60 (see FIGS. 5 & 8). The holding recess 75 and holding ledge 74 are located within the receptacle cavity 70 of the charging station 60. The holding features 75 and 74 may be shaped and/or operatively arranged in the receptacle cavity 70 to permit the holding tabs 25 to advance only to a certain position within the cavity 70. The holding ledge 74 may be arranged to retain the lateral end 32 in a particular alignment as the lateral end 32 is inserted in the cavity 70. In the embodiment in FIGS. 5-8, the features 25, 74, and 75 are configured such that the holding tab 25 travels through the holding recess 75 up to the holding ledge 74. As described herein, upon insertion of the lateral end 32 of the modular canal hearing device assembly 1 into the receptacle cavity 70, the battery module 40 is actuated for disengagement of the battery module 40 from the main module 20, as will be further described below. The features 74 and 75 may be arranged to restrain movement of the main module 20 via the holding tab 25 during this actuation of the battery module 40, to allow the battery module 40 to disengage from the main module 20. While a single holding tab 25 on each side of the main module 20 is shown in the example in FIGS. 2-4, any number of holding tabs and complementary holding features may be used without departing from the scope of the present disclosure.

The main module 20 may be connected at its medial end 31 to a seal tip assembly 80. The seal tip assembly 80 is preferably manufactured of a flexible material, such as a polymer, and configured as a replaceable or disposable component. The seal tip assembly 80 attaches to the main module 20 by engaging with a seal holding tab 26 positioned generally on the medial end 31 of the main module 20.

The battery module 40 includes a housing 43 that is generally sized and shaped according to the battery cell 42 incorporated therein, which may, in some examples, be substantially cylindrical. In a preferred embodiment, the battery cell 42 is integrated with the battery module 40 thus the battery cell 42 being non-removable. By non-removable it is generally implied, in the context of the present disclosure, that the battery cell 42 is not intended to be replaced during the life of the battery module 40. That is, the battery module 40 with non-removable battery cell 42 is replaced as a unit once the battery cell 42 is no longer functional (e.g. can no longer be recharged and/or becomes damaged). In other embodiments, the battery cell 42 may be removable from the battery module housing 43. The receiving cavity 21 within the main module housing 35 includes a first battery contact 37 and a second battery contact 36 that are configured for contacting positive and negative terminals of the battery cell 42 of the battery module 40.

In some examples, the battery module 40 includes a sound port 47 to deliver incoming sounds to the microphone within the main module 20. A waterproof debris barrier (not shown) may be placed either over, within, or underneath the sound port 47 to prevent water or debris from reaching the electronic components, and particularly the microphone in the main module 20, thus allowing the device to be worn safely during water exposure such as when swimming or showering. The debris barrier is preferably made of a porous film or membrane that is acoustically transparent (e.g., permitting sound to be transmitted across the membrane).

In some examples, the battery module 40 includes a handle 50 attached to the lateral end 44 thereof to facilitate handling of the battery module 40 and the hearing device assembly 1. In some examples as shown in FIGS. 1-8, the handle 50 includes a shaft 51 and a knob 52. As will be appreciated, such a configuration facilitates actuation and disengagement of the battery module 40 during insertion of the modular canal hearing device assembly 1 into the receptacle cavity 70.

In one embodiment, the battery module 40 comprises charging electrical contacts 46*a* and 46*b* for receiving electrical charge from the charging station 60. The charging electrical contacts 46*a* and 46*b* may be positioned on the exterior surface of the battery module housing 43, for example on top as shown in FIGS. 2-3. The charging electrical contacts 46*a* and 46*b* are typically formed from an electrically conductive material, such gold-plated beryllium copper, or other material as will be known by those skilled in the art of electrical contacts. The charging electrical contacts 46*a* and 46*b* may be positioned on the battery module 40 so as to facilitate electrical engagement with charging station electrical contacts (for example 76*a* and 76*b*) located within the receptacle cavity 70 of the charging station 60. In the examples shown, charging electrical contact 46*a* engages with charging station electrical contact 76*a*, and a charging electrical contact 46*b* engages with a charging electrical contact 76*b*.

The charging station 60 may include one or more receptacle cavities 70, each of which may be adapted for receiving the lateral end of a canal hearing device assembly 1. FIGS. 5-9 show examples of a charging station 60 with a plurality of receptacle cavities 70. In some examples, the charging station 60 includes two receptacle cavities 70 to accommodate and charge a left canal hearing device assembly 1 and a right canal hearing device assembly 1. In the preferred embodiments, each receptacle cavity 70 includes a channel 77 for receiving the handle attached to the lateral end of each canal hearing device assembly 1. In one embodiment (not shown), the charging station 60 further comprises a rechargeable battery to provide an internal power source to charge the canal hearing device assembly 1 when inserted into the charging station 60. In the preferred embodiments, the charging station 60 comprises a connector 61, shown as USB connector, to receive power from an external power source, for example from a USB port of a computer, a smart phone, or any USB power outlet. The connector 61 may be provided via a cable (not shown) to connect the charging station 60 to an external power source, including a standard wall outlet, In some examples, the charging station 60 includes an indicator 62, for example an LCD or LED indicator, to indicate the status of the charging cycle, the battery cell condition, or the charger condition, to the user. The housing 66 of the charging station 60 may include vents 63 to dissipate heat emanating from charging circuitry 65 within the housing 66. In some examples, the charging circuitry 65 includes a microprocessor or a microcontroller (not shown).

The receptacle cavity 70 of the charging station 60 is shaped to conform generally to the shape of the lateral end 32 of the canal hearing device assembly 1. In this manner the receptacle cavity 70 may be configured to accommodate the insertion of the lateral end 32 therein, while the medial end 31 of the canal hearing device assembly 1 protrudes from the receptacle cavity 70. The channel 77 within the receptacle cavity 70 includes features configured to actuate the handle 50 for disengagement of the battery module 40, providing the canal hearing device assembly 1 in the power OFF position and ready for charging as described herein.

In one embodiment, the charging electrical contacts 76*a* and 76*b* may be configured to also transmit data to and from the canal hearing device assembly 1. In the preferred embodiment, the receptacle cavity 70 includes a thermistor element (not shown) for sensing the temperature proximate to the battery cell 42 when the lateral end of the canal hearing device assembly 1 is inserted within the receptacle cavity 70. The thermistor element is preferably positioned directly at, or in the vicinity of charging electrical contacts 76*a* and 76*b* within the receptacle cavity 70. The thermistor element is generally coupled to circuitry 65 incorporated within the charging station 60, and may be configured to control the charge cycle of the canal hearing device assembly 1, partially in response to the temperature within the canal hearing device assembly 1. The charge cycle may be interrupted responsive to the thermistor detecting a temperature proximate the battery exceeding a certain threshold temperature.

Figure 9:
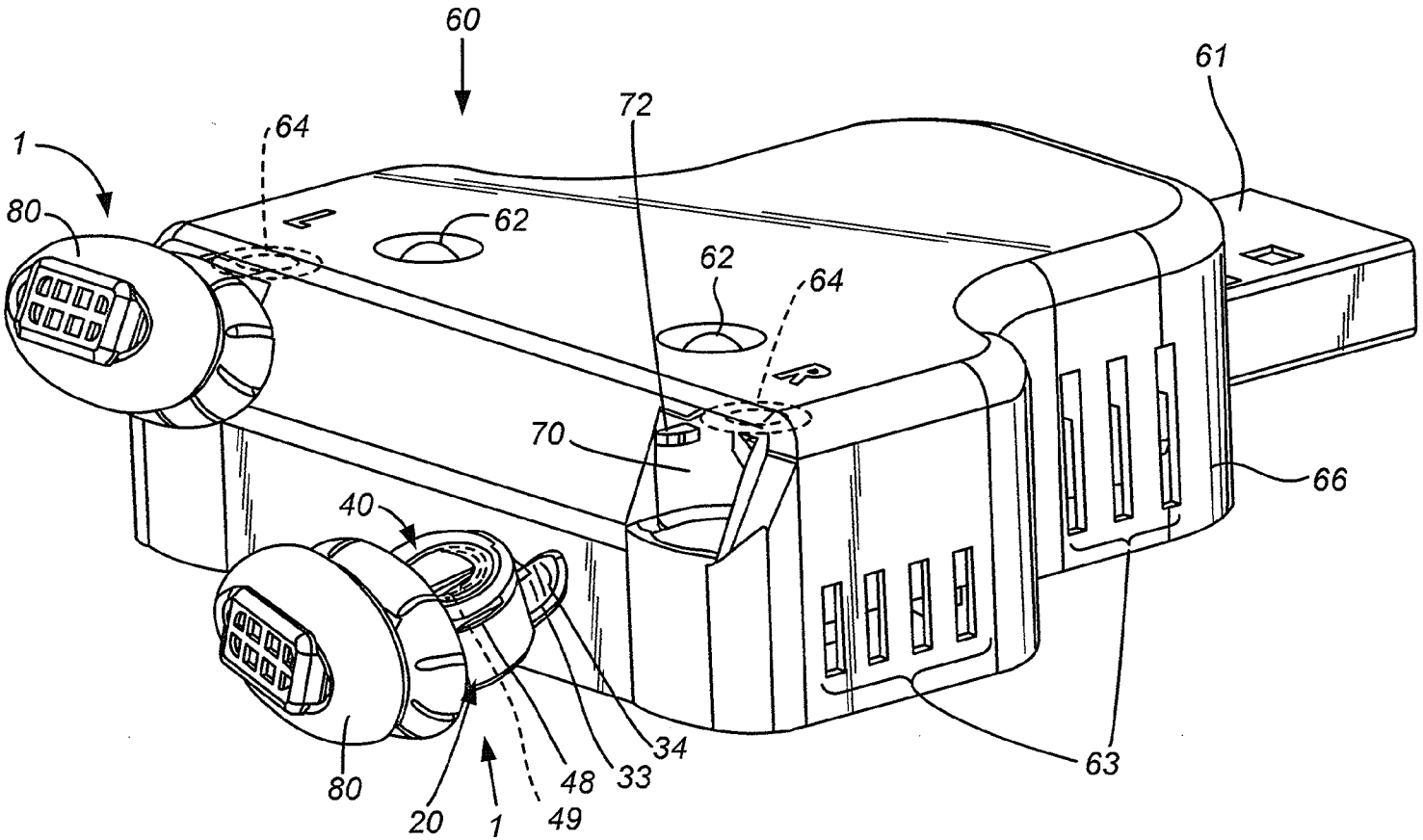
FIG. 9 is an isometric view of alternate embodiments of canal hearing device assemblies and a charging station with inductive coupling charge, also showing an alternate embodiment of a handle incorporated into the main module.
Figure 10:
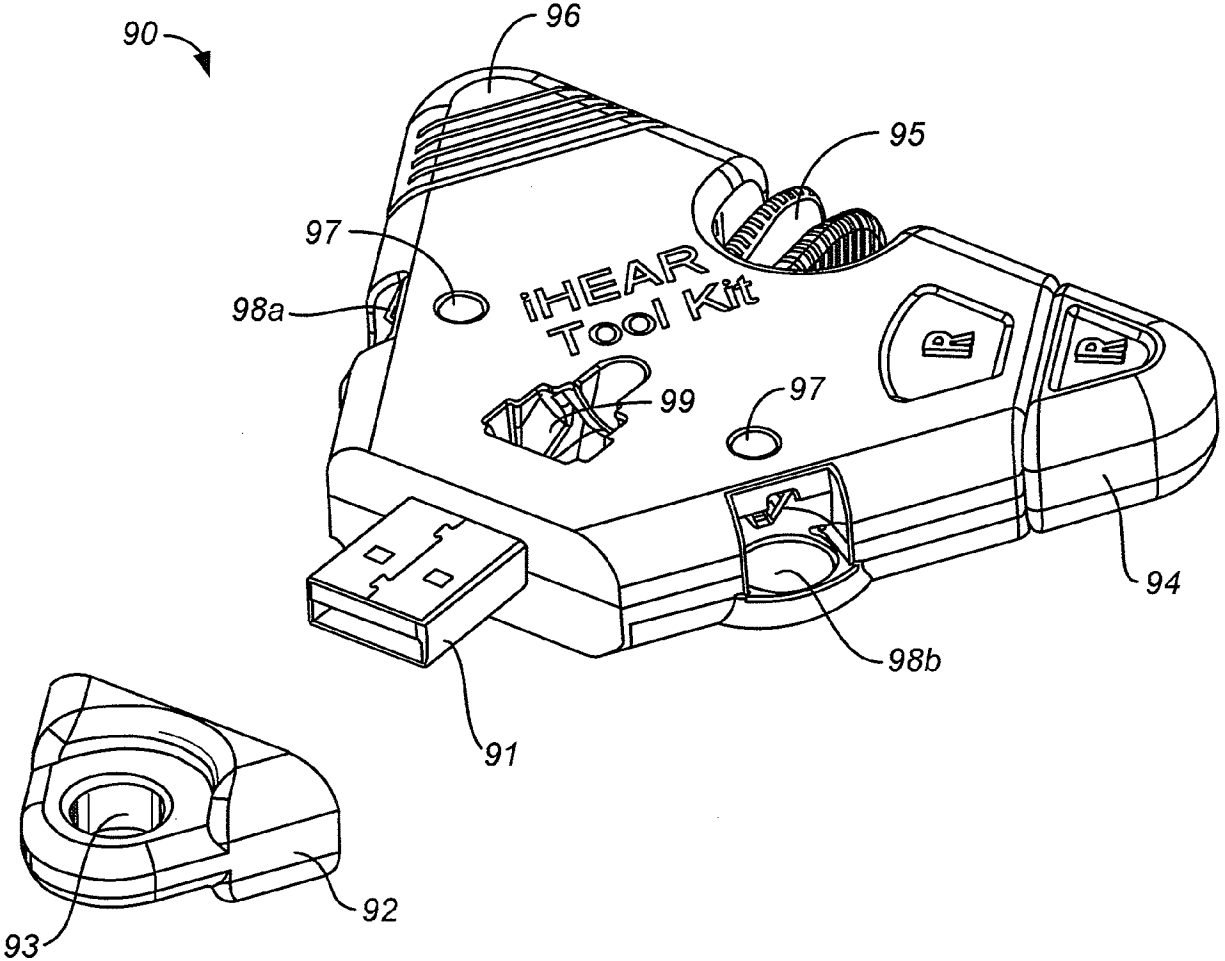
FIG. 10 is an isometric view of a multi-purpose tool kit incorporating a charging station according to some examples herein, which includes a USB connector, and additional tools for use with canal hearing device assemblies of the present disclosure.

In another embodiment shown in FIG. 9, the charging station 60 utilizes a wireless (contactless) inductive charging mechanism instead of direct electrical contacts as in embodiments described above. In this configuration, inductive coils 64 are located within the housing 66 of the charging station 60 to inductively couple electrical energy to a receiving coil assembly 49 integrated within the lateral end of the canal hearing device assembly 1.

In one embodiment, the receptacle cavity 70 includes features to secure the main module 20 within and manipulate the battery module 40 for disengagement from the main module 20. The receptacle cavity 70 is shaped with a lead-in to receive the lateral end of the canal hearing device assembly 1 towards the cavity floor 73, the holding recesses 75 located on the each side (FIGS. 5, 6 & 8) therein, and the holding ledges 74. Upon placement into the receptacle cavity 70 and application of an axial insertion force 5 (FIG. 7), generally along the longitudinal axis 2 of the canal hearing device assembly 1, the holding recess 75 and holding ledges 74 secure the main module 20 by holding the holding ledges 25 while the battery module 40 is being displaced by the disengagement ledge 71. This disengagement occurs automatically as the handle 50 and the lateral end 32 of the canal hearing device assembly are being axially inserted into the receptacle cavity 70, causing the battery module 40 to partially disengage with respect to the main module 20, creating a gap 54 (FIG. 7) separating the battery cell 42 from electrical contact 36 within the main module 20. This electromechanical separation between the battery cell 42 and the main module 20 provides the canal hearing device assembly 1 in the power OFF position.

In the above example, the battery module 40 is displaced by the disengaging ledge 71 within the channel 77 of the receptacle cavity 70, configured to push the handle 50, or the shaft part 51 thereof "up" or "upward" and/or away from the main module 20, resulting in partial disengagement of the battery module 40 and the power OFF position which may be required during charging. The channel 77 extends the receptacle cavity 70 to accommodate the handle 50 therewithin. The disengagement of the battery module 40 also engages the charging electrical contacts 46*a* and 46*b* of the canal hearing device assembly 1 with electrical contacts 76*a* and 76*b* of the charging station 60, allowing the transfer of electrical charge to the battery cell 42, and performing the charging cycle by the circuitry 65. That is, as the battery module 40 is actuated and displaces upwards relative to the main module, the charging electrical contacts 46*a* and 46*b* are advanced toward and provided in direct contact with the electrical contacts 76*a* and 76*b* of the charging station 60. In this regard, it may be said that in the examples herein, the disengagement of the battery module 40 is generally in the perpendicular direction with respect to the longitudinal axis 2 of the elongate canal hearing device assembly 1.

In an alternate embodiment of the canal hearing device system including a rechargeable canal hearing device assembly as depicted in FIG. 9, the handle 33 is incorporated with the main module 20. Grooves 34 may be provided on the handle 33 to facilitate grasping by the user's fingers. In this example, the receptacle cavity 70 includes holding tabs 72 that engage with holding recesses 48 incorporated within the battery module 40 to secure the battery module 40 while the main module 20 is being displaced to the power OFF position by the above mentioned process of insertion into the receptacle cavity 70. It will be understood that certain features for holding and disengaging the modules (e.g. modules 20 and 40) of the modular hearing device assembly 1 are generally interchangeable and reversible thus may be placed on either part of the modular canal hearing device assembly 1 or the receptacle cavity 70.

The canal hearing device assembly 1 may be provided from the OFF position to the ON position by a snap mechanism, whereby the holding tab 45 (FIG. 3) of the battery module 40 is displaced from the upper groove 23 to the lower groove 22 within the main module 20. This may be accomplished by applying a squeezing force S, for example by the user's fingers or by a tool. By positioning the holding tab 45 in the lower groove 22, the battery cell 42 comes into electrical engagement with the electrical contact 36, closing the electrical circuit for the canal hearing device assembly 1 and providing the canal hearing device assembly 1 in the power ON configuration.

In one embodiment, an integrated multi-purpose tool kit 90 (FIG. 10) is provided for the user to charge the canal hearing device assembly 1, while incorporating other tools for use with the canal hearing device assembly 1. The tools may include a remote control 96 for remotely controlling the canal hearing device assembly 1, an ear canal insertion tool 95 for insertion of the canal hearing device assembly 1 into the ear canal 10, an ear canal removal tool 94 for removing the canal hearing device assembly 1 from the ear canal 10, and a battery module removal cavity 99 for removing the battery module 40. The multi-purpose tool kit 90 may facilitate the use of the miniature canal hearing device assembly 1 by incorporating a plurality of accessories in a single portable housing. The example multi-purpose tool kit 90 incorporates two receptacle cavities, 98*a* and 98*b*, configured to function as a charging receptacle cavities 70 described in the above examples. In this example, a first receptacle cavity 98*a* is configured to receive a first canal hearing device assembly 1, for example a left canal hearing device assembly for a left ear, and a second receptacle cavity 98*b* is configured to receive a right canal hearing device assembly 1, for a right ear. The multipurpose tool kit 90 may further include one or more indicators 97 (e.g. LED lights) for indicating a stage of the charging cycle. The multi-purpose tool kit 90 may include a connector 91 configured to provide power and or data signals. For example, the connector 91 may be a USB connector configured to receive power and/or data signals from a USB port of another electronic or computing device. Data signals may be used for communication and/or programming of the charging circuitry therewithin. The connector 91 may be covered by a removable cap 92 to protect the connector 91 when not in use. The removable cap 92 may include a keychain hole 93.

Although examples of the invention have been described herein, it will be recognized by those skilled in the art to which the invention pertains from a consideration of the foregoing description of presently preferred and alternate embodiments and methods of fabrication and use thereof, and that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A canal hearing device system comprising:

a main module for positioning in the ear, the main module comprising a receiver and circuitry;

a battery module incorporating a rechargeable battery cell therein, the battery module configured for mating with the main module to form a lateral end of a rechargeable canal hearing device, wherein the lateral end of the canal hearing device comprises a handle section; and a charging station for providing electrical charge to the rechargeable battery cell, wherein the charging station comprises a receptacle cavity configured to at least partially disengage the battery module from the main module upon axial insertion, at least in part, of the lateral end of the canal hearing device into the receptacle cavity.

2. The canal hearing device system of claim 1, wherein the rechargeable battery cell is non-removable from the battery module.

3. The canal hearing device system of claim 1, wherein the receptacle cavity further comprises electrical contacts for delivering electrical charge to the rechargeable battery cell.

4. The canal hearing device system of claim 1, wherein the receptacle cavity further comprises a thermistor element configured to sense a temperature proximate to the battery cell.

5. The canal hearing device system of claim 1, wherein the receptacle cavity comprises features configured to constrain a movement of the main module with respect to the charging station.

6. The canal hearing device system of claim 1, wherein the receptacle cavity comprises a disengaging feature configured to actuate the battery module relative to the main module upon axial insertion of the lateral end into the charging station for partially disengaging the battery module from the main module.

7. The canal hearing device system of claim 1, wherein the main module further comprises first holding features and the battery module further comprises complimentary holding features, the first holding features and complementary holding features configured to maintain the battery module in either a power OFF position or a power ON position.

8. The canal hearing device system of claim 1, wherein the lateral end of the canal hearing device assembly further comprises a coil for inductively-coupling electrical energy between the charging station and the rechargeable battery cell.

9. The canal hearing device system of claim 1, wherein the charging station further comprises a coil for providing electrical charge wirelessly to the rechargeable battery cell by inductive coupling.

10. The canal hearing device system of claim 1, wherein the charging station further comprises a USB connector.

11. The canal hearing device system of claim 1, wherein the charging station further comprises a rechargeable battery.

12. The canal hearing device system of claim 1, wherein the circuitry comprises a digital signal processor.

13. The canal hearing device system of claim 1, wherein the charging station comprises an indicator configured to indicate a stage of a charging cycle of the rechargeable battery cell.

14. The canal hearing device system of claim 1, wherein the receptacle cavity is one of a plurality of cavities, each configured to accommodate respective lateral ends of a plurality of canal hearing devices.

15. The canal hearing device system of claim 1, wherein the receptacle cavity further comprises data contacts configured to provide data signals to the canal hearing device when the lateral end of the canal hearing device is inserted into the receptacle cavity.

16. A canal hearing device system comprising:

a main module incorporating a receiver and circuitry;

a battery module incorporating a non-removable rechargeable battery cell, the battery module configured to couple to the main module forming a canal hearing device assembly; and a charging station configured to provide electrical charge to the rechargeable battery cell when coupled to the main module-, wherein the charging station comprises a receptacle cavity for receiving a lateral end of the canal hearing device assembly, and wherein the receptacle cavity is configured to at least partially disengage the battery module from the main module upon axial insertion, at least in part, of the lateral end of the canal hearing device assembly into the receptacle cavity.

17. A portable charging station for charging a rechargeable canal hearing device comprising:

circuitry for providing electrical charge to a rechargeable battery cell at least partially enclosed within a battery module provided within the rechargeable canal hearing device; and a receptacle cavity for receiving a lateral end of the rechargeable canal hearing device, wherein the receptacle cavity is configured to at least partially disengage the battery module from the canal hearing device upon axial insertion of the lateral end of the rechargeable canal hearing device, at least in part, into the receptacle cavity.

18. The portable charging station of claim 17, wherein the receptacle cavity further comprises electrical contacts for delivering electrical charge to the rechargeable battery cell and/or providing data signals to the rechargeable canal hearing device.

19. The portable charging station of claim 17, wherein the receptacle cavity further comprises a thermistor element configured to sense a temperature proximate to the rechargeable battery cell.

20. The portable charging station of claim 17, wherein the receptacle cavity further comprises holding features configured to maintain the main module into a predetermined alignment with respect to the charging station.

21. The portable charging station of claim 17, wherein the receptacle cavity further comprises a ledge for disengaging the battery module from a main module upon insertion of the lateral of the rechargeable canal hearing device end into the portable charging station.

22. The portable charging station of claim 17, wherein the circuitry is further adapted to provide electrical charge to the rechargeable battery cell by inductive coupling.

23. The portable charging station of claim 17 further comprising a USB connector.

24. The portable charging station of claim 17 further comprising a battery.

25. The portable charging station of claim 17, wherein the circuitry comprises a microcontroller.

26. The portable charging station of claim 17 further comprising an indicator configured to indicate a status of the rechargeable battery cell or the charger.

27. The portable charging station of claim 17, wherein the receptacle cavity is one of a plurality of cavities, each receptacle cavity configured for receiving a lateral end of a rechargeable canal hearing device.

28. A multi-purpose tool kit including the portable charging station of the portable charging station of claim 17.

29. The multi-purpose tool kit of claim 28 further comprising any of a remote control, a removal loop, an insertion tool, or a battery removing cavity.

30. A rechargeable canal hearing device comprising:

a main module for positioning in the ear, the main module comprising a receiver, and circuitry; and a battery module incorporating a rechargeable battery cell within, wherein the battery module is configured to couple to the main module to form a lateral end of a canal hearing device when joined therewith, the lateral end configured to cause the battery module to disengage, at least in part, from the main module upon axial insertion of the lateral end, at least in part, into a receptacle cavity of a charging station.

31. The rechargeable canal hearing device of claim 30, further comprising electrical contacts adapted for charging the rechargeable battery cell.

32. The rechargeable canal hearing device of claim 30, further comprising an inductive coupling coil for wireless charging.

33. The rechargeable canal hearing device of claim 30, wherein the lateral end comprises a handle.

34. The rechargeable canal hearing device of claim 30, wherein the battery module incorporates a sound port for delivering sound to a microphone.

35. A rechargeable canal hearing device comprising:

a main module for positioning in the ear, the main module comprising a receiver and circuitry; and a battery module incorporating a non-removable battery cell, the battery module configured for mating with the main module to form a lateral end of a canal hearing device assembly, wherein axial insertion, at least in part, of the lateral end of the canal hearing device assembly into a receptacle cavity of a charging station adjusts the battery module from a first position in which the battery cell is electrically engaged to the circuitry, to a second position in which the battery cell is electrically disengaged from the circuitry.

36. The rechargeable hearing device of claim 35, wherein the battery module comprises a sound port for delivering sound to a microphone within the canal hearing device.

37. A method for charging a canal hearing device including a battery module within, the method comprising:

inserting a lateral end of the canal hearing device axially at least partially into a receptacle cavity of a charging station, the receptacle cavity including features configured to automatically disengage the battery module from the canal hearing device, the lateral end of the canal hearing device comprising first electrical contacts for receiving electrical charge from second electrical contacts within the receptacle cavity;

applying an axial insertion force generally along the longitudinal axis of the canal hearing device assembly to disengage the battery module from the canal hearing device and to electrically engage the first electrical contacts of the canal hearing device with the second electrical contacts of the charging station; and charging a battery cell at least partially incorporated within the battery module by the charging station.

38. The method of claim 37, wherein the battery module disengages from the canal hearing device within the receptacle cavity in a generally perpendicular direction relative to the longitudinal axis of the canal hearing device.

39. The method of claim 37, wherein disengaging the battery module from the canal hearing device provides the canal hearing device assembly in a power OFF configuration.

40. A method for charging a rechargeable canal hearing device comprising a battery module incorporating a battery cell within, the method comprising:

inserting a portion of the rechargeable canal hearing device axially into a receptacle cavity of a charging station, the receptacle cavity including features for automatically disengaging the battery module from the rechargeable canal hearing device;

applying an axial force, generally along a longitudinal axis of the rechargeable canal hearing device, to disengage the battery module from the rechargeable canal hearing device, wherein disengaging the battery module includes moving the battery module in a generally perpendicular direction with respect to the longitudinal axis of the rechargeable canal hearing aid; and charging the battery cell while the rechargeable canal hearing device is partially inserted in the receptacle cavity.

* * * * *